US005238246A

United States Patent [19]

Erb

[11] Patent Number: 5,238,246

[45] Date of Patent: * Aug. 24, 1993

[54] SPLIT GRIP FOR THE HANDLE OF A BASEBALL BAT

[75] Inventor: Albert R. Erb, Ortley Beach, N.J.

[73] Assignee: Rotary-Grip TM, Inc., Island Hts., N.J.

[ * ] Notice: The portion of the term of this patent subsequent to Jul. 30, 2008 has been disclaimed.

[21] Appl. No.: 829,259

[22] Filed: Feb. 3, 1992

[51] Int. Cl.[5] ..... A63B 59/06

[52] U.S. Cl. ..... 273/72 R; 273/72 A; 273/26 B

[58] Field of Search ..... 273/81 C, 81 B, 72 R, 273/72 A, 67, 26 B; 81/489

[56] References Cited

U.S. PATENT DOCUMENTS

| | | | |
|---|---|---|---|
| 2,471,610 | 5/1949 | Christensen | 273/72 R |
| 2,984,486 | 5/1961 | Jones | 273/72 R |
| 5,011,145 | 4/1991 | Bartkowicz | 273/72 R |
| 5,035,428 | 7/1991 | Bartkowicz | 273/72 R |

*Primary Examiner*—Mark S. Graham

*Attorney, Agent, or Firm*—Stephen W. White

[57] ABSTRACT

A novel, split grip, swing enhancing device suitable for use with a baseball bat is described. This device is made from a flexible, slippable, pliable plastic material and can be installed under a conventional gripping sleeve commonly found on most baseball bats. The split grip is placed under one of the user's hand location (the upper hand) and will insure a smooth and level swing and the proper alignment of the hands. The device can be installed during the manufacture of the bat or can be added later.

7 Claims, 2 Drawing Sheets

SPLIT GRIP FOR THE HANDLE OF A BASEBALL BAT

BACKGROUND OF THE INVENTION

1. Cross-reference to Related Applications

This application is related to U.S. Pat. Nos. 5,011,145 and 5,035,428 and to a co-pending application U.S. Pat. No. 07/763,992, filed, Sep. 23, 1991 pending. All of these previous references describe rotating gripping means for improving the handling and performance of baseball bats. This application is a simpler device and is an improvement thereover.

2. Field of the Invention

This invention is related to the game of baseball and specifically to bats used to play said game. Still more specifically, this invention is related to an improved and very simple grip that may be applied to the handles of baseball bats to achieve improved swings thereof. Finally, this invention relates to an improved grip that can be manufactured simply and inexpensively and easily installed on the handle of a baseball bat.

3. Discussion of the Prior Art

There are a number of prior art references that describe how baseball bats are used to play the game of baseball. There are also a number of other prior references that relate to batting devices employed to play other games. Baseball is, however, a unique game in which one team uses a player (the "pitcher") who employs a baseball that is hurled at very high speeds towards an opposing player (the "batter") who uses a small object (e.g., a baseball bat) to try and strike the ball to a designated place on the playing surface. It is a difficult chore to strike this ball for a number of reasons. The primary reason is that is very difficult simply to hit the ball because of its size and speed of delivery. Additionally, the pitcher can employ a hurling or throwing delivery that will cause the ball to dip or curve in various directions. Consequently, a level, smooth and consistent swing is a necessity in order for the batter to get the bat to meet the ball squarely and thus perform his or her function.

There are several forms and types of baseball played and these games may be played by amateurs or by professionals. For example, hardball baseball is played by professional teams throughout the United States, Canada, Mexico, South America, Cuba and in the Far Eastern countries, for example. There are major league teams as well as minor league teams who perform for pay. In addition, this game is played in colleges, high schools and by Youth League Teams throughout the aforementioned countries. Then, there are softball teams who employ a larger, softer ball. All, however, use a bat of similar shape and varying sizes and weights within their individual games.

A baseball bat usually is made up of three parts. There is an end, sometimes called the "barrel" that is used to strike the ball and this part is usually the largest part of the bat. There is also a handle end that is gripped to the batter employs the bat during the game. Additionally, there is a knob usually located at the end of the handle that is used to assist the user and to insure that the bat does not slip through the user's hands when swinging. Many baseball bats are made from wood but it is conventional in this day and age to employ bats made from aluminum or composites such as graphite or ceramics since they will last longer during play and can be manufactured more easily and with a greater degree of consistency than wooden bats. Most of the bats used in the amateur ranks and in softball employ the aluminum bat and most of these have some sort of cover over the handle to assist in gripping the bat. These covers are conventionally applied just above the aforementioned knob. This cover is conventionally a sleeve of some sort that is applied to the grip during the manufacture thereof. The cover may be of rubber or plastic and sometimes leather is used. The cover is used to assist in the ultimate gripping of the bat and to insure that said grip is firm.

Additionally, in the aforementioned references there are described numerous other devices employed in the prior art to improve the swing of various hitting devices found within the sporting world. These include gripping means for golf clubs, tennis racquets, for example. None of these prior art references teach how to improve the swing of a baseball bat.

In the aforementioned U.S. Patents and application cross-referenced above, there are described three separate and distinct methods for improving the hand grip on a baseball bat. These references specifically describe some sort of rotating means that can be applied to the bat. The two mentioned patents described improved rotating devices that can be applied after the manufacture of the bat while that of the aforementioned application describes an improved device to be installed during the manufacture of the bat itself. By installing the devices of any of these inventions on the handle of a conventional baseball bat, the swing of the user can be improved considerably as well-described therein. However, all three of these gripping means for insuring a level and smooth swing, are somewhat complicated and costly to manufacture and install. Therefor, a pressing need exists to find a simple baseball gripping means that will employ all of the aforementioned improvements on swing, etc., and yet be inexpensive and easy to install on a bat during and after the manufacture thereof. The teaching of the cross-referenced material is incorporated herein by reference.

SUMMARY OF THE INVENTION

It is an object of this invention to provide a simple, inexpensive yet improved gripping means for the handle of a baseball bat and one that can be applied on said handle after and during the manufacture thereof. It is also an object of this invention to provide an improved gripping means applied on the handle of any of the conventional baseball bats. These and yet other objects are achieved in a baseball bat used for playing baseball in a swingable manner comprising in order a hitting or barrel end and a handle end, said handle end being grippable by both hands of the user thereof, said handle also having a knob end and a gripping sleeve applied thereon, the improvement comprising placing over said handle and under said gripping sleeve a swing enhancing device comprising a thin, long tube of a flexible, slippable, pliable plastic material split to provide ends in a longitudanal direction, said device designed to fit under one of the hands of said user.

DETAILS OF THE INVENTION

Figure 1:
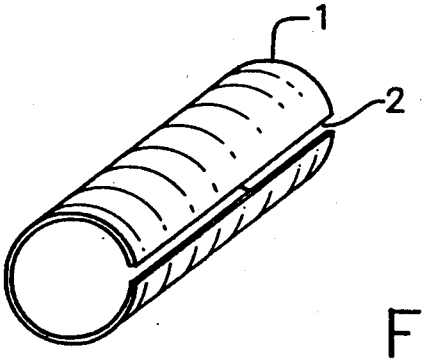
FIG. 1 is a showing of one of the versions of the swing enhancing device of this invention (hereinafter referred to as a "split grip").

Referring now specifically to the drawings which particularly exemplify the baseball bat of this invention and the unique swing enhancing devices employed thereon, FIG. 1 is a showing of one of the preferred versions of the swing enhancing device or split grip of this invention. In this showing, the grip 1 is split 2 which is shown as a perpendicular longitudinal split within the material of construction. When this particular grip is installed, the joint or split 2 will be butt-to-butt.

Figure 2:
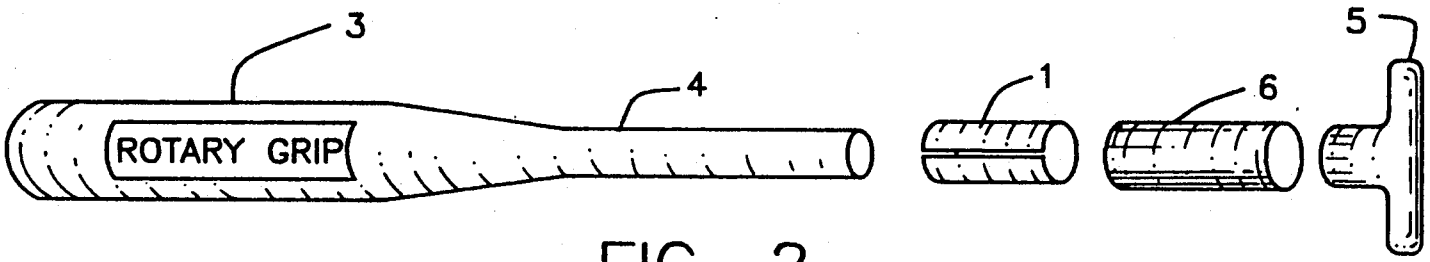
FIG. 2 is a showing of the various parts of a baseball bat including the split grip from FIG. 1.

FIG. 2 is a showing of the various parts of a baseball bat before final assembly, including the split grip of FIG. 1. In this showing, 3 is the hitting or barrel end of the bat, 4 is the handle end, 5 is the knob usually installed at the end of the handle, 6 is a gripping sleeve which when installed covers the swing enhancing device or split grip 1 as shown in FIG. 1.

Figure 3:
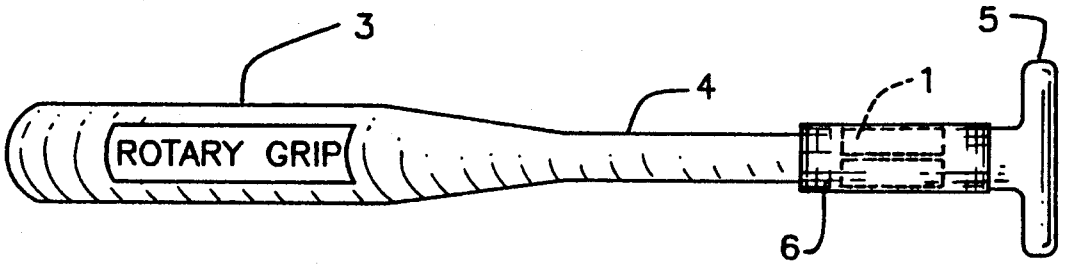
FIG. 3 is a showing from FIG. 2 with all of the parts assembled.

FIG. 3 shows the elements described in FIG. 2 completely assembled. In this showing, the hitting end 3 along with the handle 4 have been mated with the knob 5. Prior to this step, the split grip 1 is placed on the handle end and the gripping sleeve 6 is placed over this device. In this showing, the split grip 1 is shown in dotted lines to indicate its position under the gripping sleeve 6.

Figure 4:
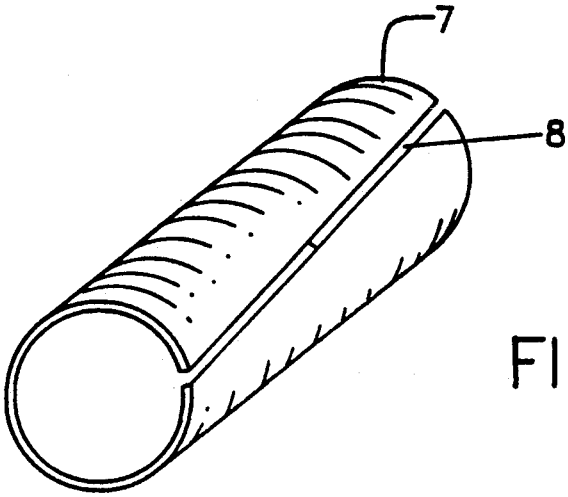
FIG. 4 is another version of the split grip of this invention.

FIG. 4 is another version of the swing enhancing device of this invention. In this showing, the device 7 is split 8 at a longitudinal angle as compared to the perpendicular longitudinal split shown in FIG. 1.

Figure 5:
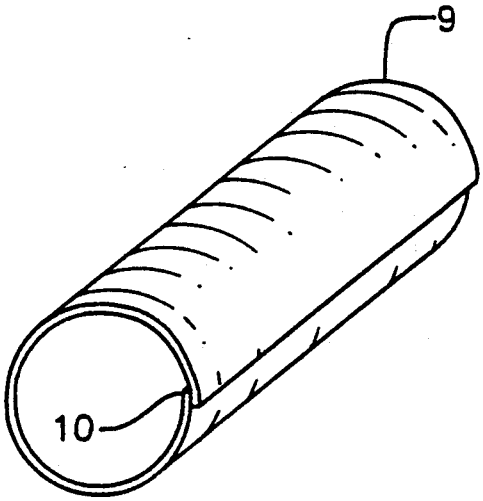
FIG. 5 is yet another version of the split grip of this invention.

FIG. 5 is yet another version with the device 9 having an overlap 10 arrangement of edges. In this version, the split grip would be of somewhat larger circumference than the handle of the bat. However, after separation along the split, the device can be easily installed on the handle of the bat.

The split grip of this invention can be manufactured from a myriad of flexible, pliable plastic materials. Preferably, this material is made from an ultra high molecular weight and dense polymer such as polyethylene; methacrylates; among others. A particularly preferred material is an ultra high molecular weight (e.g., M. W. 2,000,000 or greater) polyethylene. These materials are pliable yet firm and can be formed into the desired length and thickness in a tube-like format. Then, the tube can be cut into the users needed length (e.g., to fit the hand of the user) and split longitudinally as wanted. The diameter of the tubing should be within the ranges of any of the commonly known baseball bat handles in order to fit over the handle thereof. Prior to placing a gripping sleeve is placed over the split grip of this invention, the split grip may be adjusted to any position to suit the particular user or batter. The split grip may be placed high in order to affect a so-called "choke-up grip" on the bat. It may also be placed in another position as desired. The split grip is intended to fit one of the hands of the batter, the hand that is highest up on the grip, and may be used by either right- or left- handed batters as well. After the gripping sleeve is installed over the split grip, the upper hand of the batter will be over the split grip and the lower hand will not have any split grip thereunder. When used in this fashion, the gripping position of the hands will be maintained in the desired fashion ensuring that the swing is level and true. Thus, the batter will hit more line drives and less short, pop-up fly balls. The split grip can be made in usable lengths of 3 to 6 inches and can be of a thickness range from 3 to 20 mils, with a preferred thickness of 10 mils.

The split grip of this invention may be installed on a baseball bat during the manufacture thereof or it may be added to an already manufactured baseball bat. In the latter instance, the gripping sleeve is simply rolled down and the split grip of this invention is parted along the split and installed at its desired location. Thus, the split grip of this invention is useful as an after addition by users thereof as well as to the baseball bat industry.

The split grip of this invention does not require multiple layers or interlocking devices as does that of the prior art. If the material of construction is pliable yet durable and with the desired slip, it can be simple to manufacture and install and will perform well under common usage.

I claim:

1. A baseball bat used for playing baseball in a swingable manner comprising in order a barrel end and a handle end, said handle end being grippable by both hands of the user thereof, said handle also having a knob end and a gripping sleeve applied thereon, wherein the improvement comprises a swing enhancing device comprising a thin, long tube of a flexible slippable, pliable plastic material split to provide ends in a longitudinal direction placed over said handle end and under said gripping sleeve, said device designed to fit under one of the hands of said user.

2. The swing enhancing device of claim 1 wherein said longitudanal split is disposed in a parallel manner along the length of said tube and said ends are butted end-to-end.

3. The swing enhancing device of claim 1 wherein said longitudinal split is angularly disposed to the length of said tube and wherein said ends are butted end-to-end along the angular length thereof.

4. The swing enhancing device of claim 1 wherein said ends produce by said longitudinal split are overlapped.

5. The swing enhancing device of claims 1 wherein said tube length is from 3 to 6 inches and said device has a thickness of from 3 to 20 mils.

6. The swing enhancing device of claim 1 wherein said tube length is 4 inches, said tube thickness is 10 mils.

7. The swing enhancing device of claim 1 wherein said flexible, pliable plastic material is high density polyethylene.

* * * * *